United States Patent [19]

Dyki

[11] Patent Number: 4,714,437

[45] Date of Patent: Dec. 22, 1987

[54] ELECTRICAL CONNECTOR

[75] Inventor: Joseph J. Dyki, Dearborn, Mich.

[73] Assignee: Ford Motor Company, Dearborn, Mich.

[21] Appl. No.: 5,066

[22] Filed: Jan. 20, 1987

[51] Int. Cl.[4] ..... H01R 13/40

[52] U.S. Cl. ..... 439/595; 439/748

[58] Field of Search ..... 339/59 R, 59 M, 60 R, 339/60 M, 61 R, 61 M, 94 R, 94 M, 217 S; 439/595, 748, 592, 594, 586

[56] References Cited

U.S. PATENT DOCUMENTS

| | | | |
|---|---|---|---|
| 3,170,752 | 2/1965 | Horssen | 339/217 |
| 3,430,185 | 2/1969 | Sitzler et al. | 339/59 |
| 3,686,619 | 8/1972 | McCardell, Jr. et al. | 339/59 M |
| 3,937,545 | 2/1976 | Cairns et al. | 339/60 R |
| 4,045,112 | 8/1977 | Rodondi et al. | 439/595 |
| 4,124,264 | 11/1978 | Kato et al. | 339/59 M |
| 4,127,314 | 11/1978 | Hasimoto | 339/59 M |
| 4,133,599 | 1/1979 | Powell | 339/258 R |
| 4,557,542 | 12/1985 | Coller et al. | 339/59 M |
| 4,565,416 | 1/1986 | Rudy et al. | 439/748 |

FOREIGN PATENT DOCUMENTS 3313193 10/1984 Fed. Rep. of Germany .... 339/59 R

*Primary Examiner*—Joseph H. McGlynn
*Assistant Examiner*—Paula A. Austin
*Attorney, Agent, or Firm*—Jerome R. Drouillard; Roger L. May

[57] ABSTRACT

A separable electrical connector for a plurality of axially connectable cylindrical electrical terminals adapted for coupling to the threads of insulated wires and having an annular external recess on each of the terminals. The connector include an elongated, rigid, nonconductive, generally tubular member having a plurality of apertures extending axially therethrough and a plurality of outboard ramping retention abutments formed integrally with the tubular member upon at least one inner surface of a radially outboard portion of the tubular member. A plurality of axially extending terminal guide fingers is included upon a central land located within the tubular member. A spacer engages with the central land for displacing the terminal guide fingers in the direction of the ramping retention abutments so that the terminals will be retained securely within the connector assembly.

3 Claims, 15 Drawing Figures

ELECTRICAL CONNECTOR

BACKGROUND OF THE INVENTION

This invention relates to an electrical connector for connecting a plurality of pairs of electrical conductors.

DISCLOSURE INFORMATION

Electrical connectors typically comprise an internal terminal assembly constructed of an electrically conducting material and an outer housing surrounding the terminal so as to insulate the terminal, thereby preventing the terminal from contacting any other portion of an electrical apparatus. Such terminals are frequently of the separable, axially connectable type in which male and female terminal halves are axially mated in order to make the electrical connection. To achieve axial connection of the terminal halves, force must be applied to the terminals, but because the terminal halves are usually encased within an outer housing, the terminal halves may become detached from their respective outer housings in the event that they are not properly retained within the outer housings.

A variety of schemes have been implemented for retaining terminals within connector housings. Such schemes generally fall into two categories. In the first category, are found electrical connector apparatus in which the terminal is inserted into a housing and retained by the interaction of the housing and the terminal with no further steps. Examples of such electrical connector apparatus are shown in U.S. Pat. Nos. 3,170,752, 3,430,185, 4,124,264, and 4,133,599. The types of connectors shown in the aforementioned patents suffer from a deficiency inasmuch as the force required to insert the terminal into the connector housing can be quite high and this may cause undesired deformation of the terminal. Alternatively, if excessive insertion forces are mitigated, the retention force of the terminal within the connector housing may be compromised. FIG. 1 shows such a connector.

In an effort to achieve both reasonable insertion forces for inserting terminals within connector housings, while at the same time providing a connector assembly in which high forces will be needed to separate the terminal from the connector housing, designers have utilized multiple component connector housings in which a spacer is employed for the purpose of changing a dimension of the connector housing once the terminals have been inserted. An example of such a connector is shown in U.S. Pat. No. 3,937,545, which is assigned to the assignee of the present invention. Although the connector illustrated in '545 patent is of the multiple component design, the force required to separate the terminals from the connector housing is limited because the retention structures of the terminals are engaged by relatively small detents mounted at the center of the connector assembly. Because these detents can embrace only a small portion of an external recess formed on each terminal, the retention force of the terminals within the connector assembly is not acceptable for certain applications, such as the wiring of electrical devices found in certain areas of an automobile. Moreover, as the size of a connector is reduced in order to improve its package efficiency, the area of contact between the detent device and the terminal will be reduced and this reduction will necessitate increased expenditures to reduce manufacturing tolerances in order to assure that adequate retention capability is maintained.

It is an object of the present invention to provide an electrical connector in which the cover of the connector housing is integral with the spacer assembly. In this manner, the tubular portion of the connector housing may be open in the front, and this will, according to the present invention, allow the provision of outboard ramping retention structures. These outboard structures, embracing up to one-half of the circumference of the annular external recess of each of the electrical terminals included in the connector, will greatly enhance the push-out/pull-out strength of the connector. It should be noted that for the purposes of this document, "push-out/pull-out" refers to axial displacement of the terminal from the connector housing.

It is a feature of the present invention that a connector according to this invention will be more easily manufactured because the design of the connector assembly is more forgiving of manufacturing tolerance errors.

Other objects, features and advantages of the present invention will become apparent in view of the following disclosure.

SUMMARY OF THE DISCLOSURE

According to the present invention, a separable electrical connector comprises an elongated, rigid, nonconductive, generally tubular member having a plurality of apertures extending axially therethrough, with a plurality of outboard ramping retention abutments formed integrally with said tubular member upon at least one inner surface of a radially outboard portion of the tubular member so that each of the said apertures has at least one of said outboard ramping retention abutments extending radially inward into the aperture. A connector according to the present invention further comprises a plurality of axially connectable, cylindrical electrical terminals adapted for coupling to the ends of insulated wires, where each terminal has an annular external recess in its cylindrical peripheral surface, with one of said terminals seated in each of said apertures such that said annular external recess of each terminal is engaged with at least one of said outboard ramping retention abutments. An electrical connector according to the present invention further comprises a central land located within the tubular member and defining a portion of each of said apertures with said central land comprising a plurality of axially extending terminal guide fingers, with each of said fingers having a portion extending in juxtaposition to one of said ramping retention abutments. A connector according to the present invention further comprises spacer means axially engaged with central land, for displacing said terminal guide fingers in the direction of said ramping retention abutments so that said ramping retention abutments will retain said terminals within said apertures.

A spacer means for an electrical connector according to the present invention comprises a plurality of blades with each of said blades interposed between at least two of said terminal guide fingers, said spacer means further preferably comprising cover means for said connector. Said cover means includes a plurality of apertures extending through the cover for receiving a plurality of terminals with at least one of said apertures corresponding to each of said apertures in said tubular member.

The outboard ramping retention abutments included in an electrical connector according to the present invention will preferably engage from one-quarter to one-half of the circumference of the annular external recess of each of said electrical terminals.

Each of the plurality of axially extending terminal guide fingers preferably comprises a generally elongate, rectangular cross-section body having a semi-circular guideway formed on an outboard surface thereof, with each of said fingers being cantilevered from a bulkhead extending transversely across the interior of said tubular member.

In order to prevent the electrical terminals of the present connector from moving out of the connector in the direction in which the terminals were previously inserted into the connector, the tubular member preferably further comprises non-ramping abutment means for engaging the mating ends of the terminals.

In a second preferred embodiment, a connector according to the present invention further comprises a plurality of inboard ramping retention abutments formed integrally with said terminal guide fingers with at least one of said inboard abutments extending radially outward into each of said apertures in correspondence of said outboard ramping retention abutments.

DESCRIPTION OF THE PREFERRED EMBODIMENTS

Figure 1:
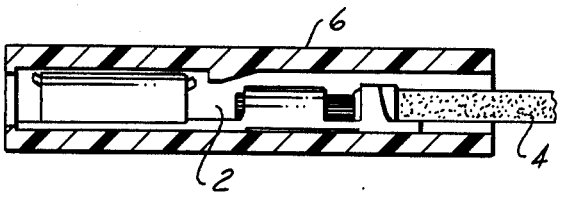
FIG. 1 PRIOR ART
FIG. 1 is a cross-sectional view of a prior art electrical connector having a one-piece housing.
Figure 2:
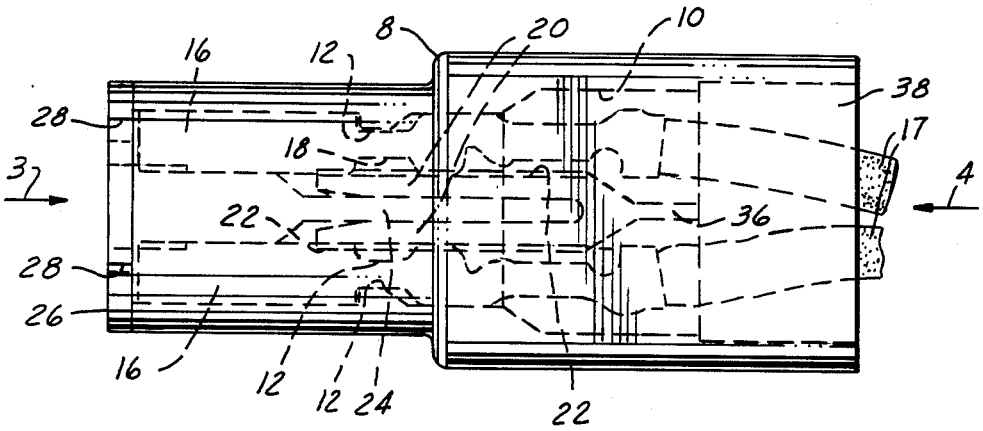
FIG. 2 is an elevation showing various component parts of an electrical connector according to the present invention.

As shown in FIG. 2, an electrical connector according to the present invention has an outer housing comprising generally tubular member 8 and cover 26. It will be understood in view of this disclosure that only one-half of a connector assembly having the female portion of mating electrical terminals is shown, it being understood that the other half of the connector assembly, having the male portion of the mating electrical terminals, would normally be constructed in similar fashion to the construction shown herein.

As shown in FIGS. 2 and 11–13, generally tubular member 8 is an elongated, rigid, nonconductive member having a plurality of apertures 10 extending therethrough. Apertures 10 extend from one end of generally tubular member 8 to the other end thereof. Because generally tubular member 8 is open at both ends, it is possible to mold and thereby form integrally with tubular member 8 a plurality of outboard ramping retention abutments 12. Ramping retention abutments 12 are preferably formed upon at least one inner surface of a radially outboard portion of generally tubular member 8 so that each of the apertures 10 extending through the generally tubular member has at least one of said ramping retention abutments extending radially inward into each aperture.

Figure 11:
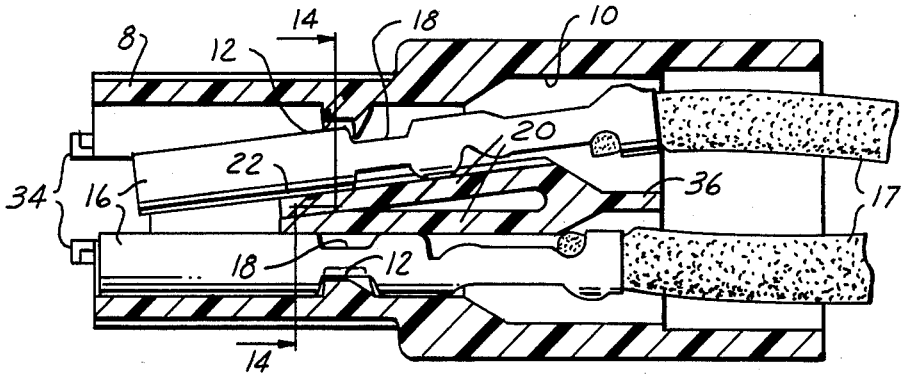
FIGS. 11 and 12 are cross-sectional views of a connector according to the present invention taken along the Line 11—11 of FIG. 3.
Figure 12:
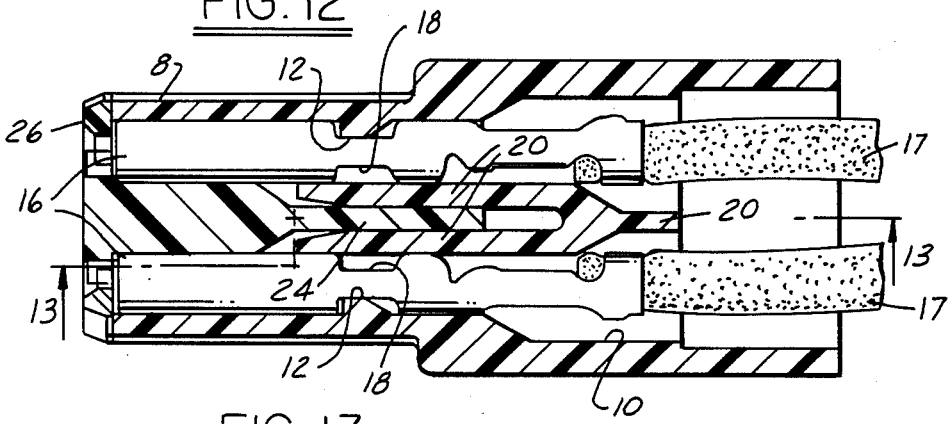
Figure 13:
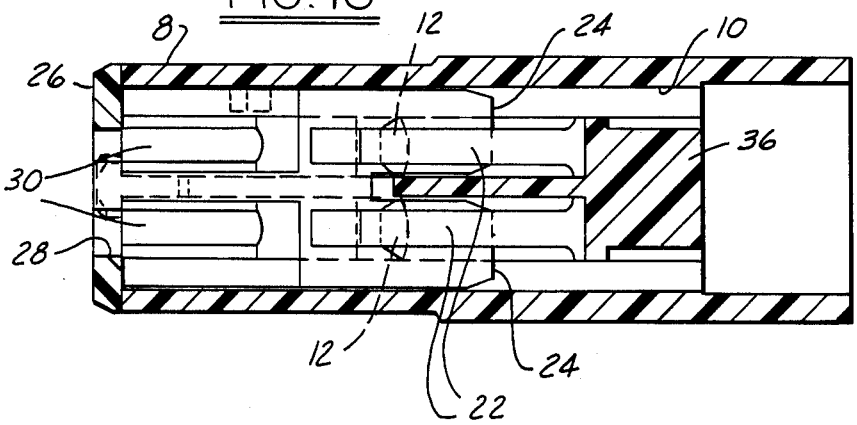
FIG. 13 is a cross-sectional view of the connector of FIG. 12 taken along the Line 13—13 of FIG. 12.

The function of outboard ramping retention abutments 12 may be understood with reference to FIGS. 11–13. As shown in FIG. 11, electrical terminal 16 at the upper portion of FIG. 11 is being inserted into an aperture 10 within generally tubular member 8. The long cylindrical portion of the electrical terminal is allowed to ride up over outboard ramping retention abutment 12 until an annular external recess 18 on the terminal becomes engaged with outboard ramping retention abutment 12. At such time as the outboard ramping retention abutment and the annular external recess become engaged, the terminal will be seated within the connector a shown in the lower portion of FIG. 11 and in FIG. 12.

Figure 14:
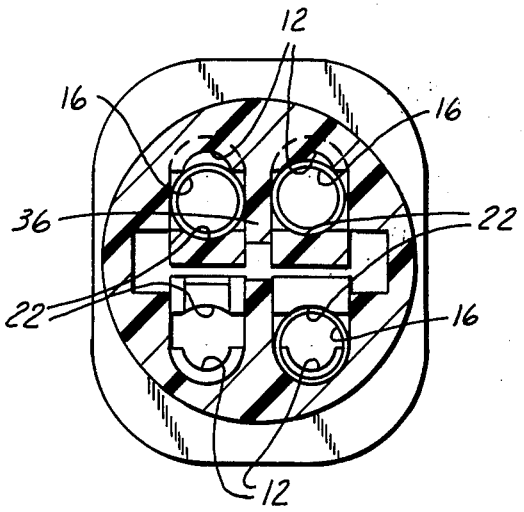
FIG. 14 is an enlarged cross-sectional view of the connector shown in FIG. 11 taken along the Line 14—14 of FIG. 11.

Passage of the terminal into aperture 10 is assisted by terminal guide fingers 20. Terminal guide fingers 20 each have a portion extending in juxtaposition to one of ramping retention abutments 12. Each guide finger 20 comprises a generally elongate, rectangular cross-section body having a semi-circular guideway 22 formed on an outboard surface thereof with each of the fingers being cantilevered from bulkhead 36 which extends transversely across the interior of tubular member 8. The details of the terminal guide fingers are shown with particularity in FIGS. 11–13. As shown in FIG. 11, a terminal being inserted into one of apertures 10 is pushed along semi-circular guideway 22 formed on one of terminal guide fingers 20. The terminal guide fingers are allowed to elastically deform as shown in FIG. 11 so that the cylindrical front portion of terminal 16 will be allowed to ride up and over outboard ramping retention abutment 12 as previously described. FIG. 14 shows another view of terminal 16 being inserted into the connector assembly. The upper two terminals shown in FIG. 14 are in the process of riding up and over outboard ramping retention abutments 12 whereas the lower terminal in the figure is fully seated with its annular external recess engaged with an outboard ramping retention abutment. The nature of the outboard ramping retention abutments may be further understood by viewing FIGS. 3 and 4 which show end views of the abutments.

Each outboard ramping retention abutment 12 engages at least one-quarter of the circumference of the annular external recess 18 of a corresponding electrical terminal 16. Preferably, one-half of the circumference of the annular external recess of each of the electrical terminals is engaged.

Figure 3:
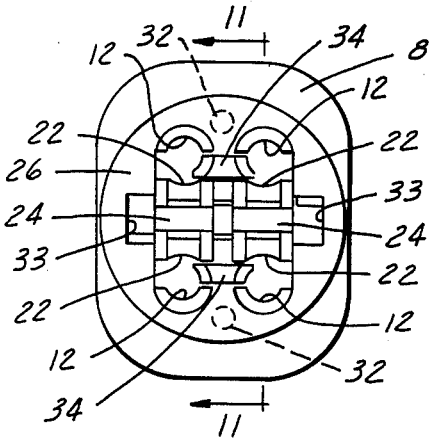
FIG. 3 is an elevation of the connector of FIG. 2 taken in the direction of Arrow 3 of FIG. 2.

Once the plurality of terminals 16 have been inserted into the connector assembly and the ramping retention abutments have been engaged with the circular external recesses on the terminals, the terminals are prevented from being pulled out of the connector by any tension imposed upon the terminal by conductors 17. Furthermore, the seated terminals are restrained from moving out of the connector in the direction in which the terminals were inserted into the connector by means of a plurality of non-ramping abutments 34 which are preferably integral with generally tubular member 8. Non-ramping abutments 34 are best shown in FIGS. 3 and 11.

After each of terminals 16 has been seated in its respective aperture 10, a spacer means is axially engaged with the central land for displacing the terminal guide fingers in the direction of the ramping retention abutments so that the ramping retention abutments will retain the terminals within the apertures. As best shown in FIGS. 5, 6, 9 and 10, a preferred spacer means comprises a plurality of blades 24, with each of the blades interposed between at least two of the terminal guide fingers 20. As shown in FIGS. 5–10, spacer blades 24 are joined with integral cover 26 which has a plurality of apertures 28 for accepting male terminals inserted through the apertures and mating with female terminals 16 contained within the electrical connector. The spacer assembly also includes a plurality of terminal guideways 30 which mate with terminals 16 as the spacer assembly is inserted into the generally tubular member 8. These terminal guideways as before comprise semi-circular channels molded integrally into the spacer assembly.

The spacer assembly and generally tubular member 8 are preferably molded of polypropylene having glass filling of about 30%. Those skilled in the art will appreciate in view of this disclosure, however, that a connector according to the present invention could be molded of a variety of other materials known to those skilled in the art.

Figure 4:
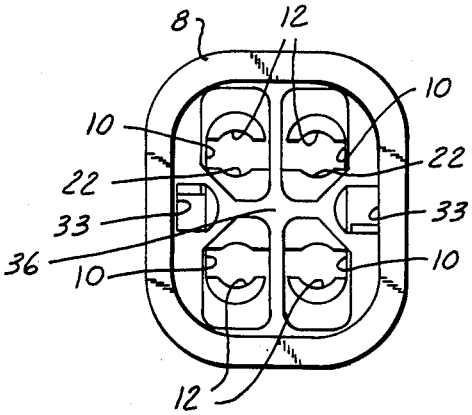
FIG. 4 is an elevation of the connector shown in FIG. 2, taken in the direction of Arrow 4 of FIG. 2.
Figure 5:
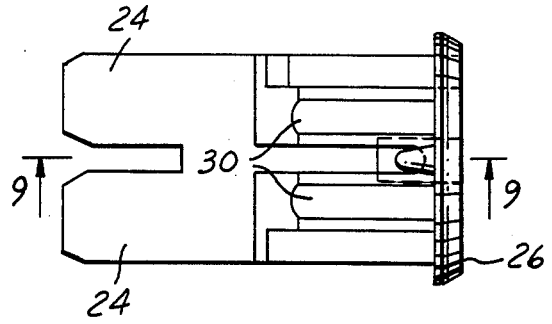
FIG. 5 is an elevation of an integral cover and spacer assembly according to the present invention.
Figure 6:
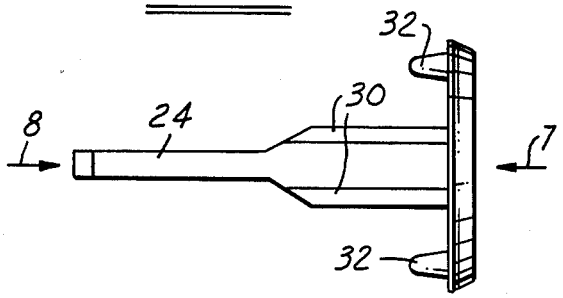
FIG. 6 is a side elevation of a spacer assembly shown in FIG. 5.
Figure 7:
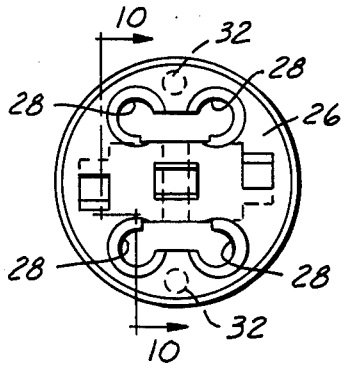
FIG. 7 is an end elevation of the spacer assembly of FIG. 6 taken in the direction of Arrow 7 of FIG. 6.
Figure 8:
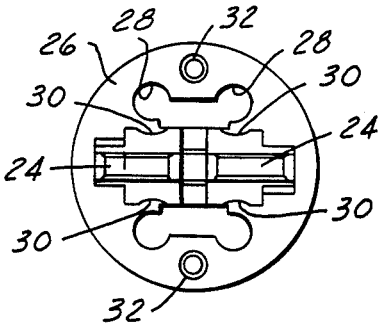
FIG. 8 is an end elevation of the spacer assembly shown in FIG. 6 taken in the direction of Arrow 8 of FIG. 6.
Figure 9:
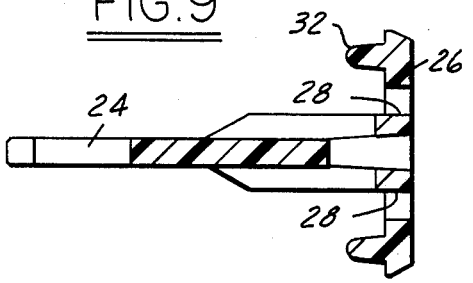
FIG. 9 is a cross-sectional view of the spacer assembly of FIG. 5 taken along the Line 9—9 of FIG. 5.
Figure 10:
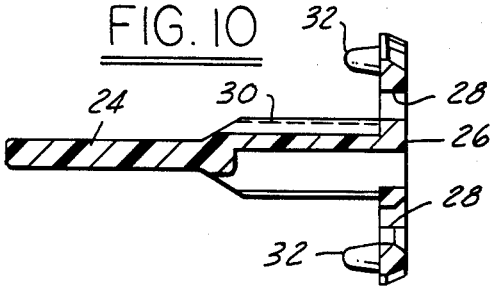
FIG. 10 is a cross-sectional view of the spacer assembly of FIG. 7 taken along the Line 10—10 of FIG. 7.

As shown in FIG. 6, a plurality of cover attaching pins 32 is integrally molded with cover 26 of the spacer assembly. The cover attaching pins mate with apertures 33 formed within generally tubular assembly 8, as shown in FIG. 4. The attaching pins perform two functions. The first function of attaching pin 32 is, as previously stated, to attach the spacer assembly, including the cover, to the balance of the connector. The second function of the cover attaching pin 32 is to index the cover portion of the spacer assembly properly to the front face of the generally tubular member B. Unlike prior art connectors which have the cover molded with the remainder of the connector body in one integral part, the present spacer assembly, by virtue of its inclusion of the connector's cover, offers an advantage in that the front face of generally tubular member 8 is allowed to be open. In turn, because the front face of tubular member 8 is open, it is possible to mold the ramping retention abutments within member 8.

Those skilled in the art will appreciate in view of this disclosure that the cover and spacer assembly disclosed herein may be attached to the balance of the connector not only by the means illustrated herein, but also by such methods of chemical bonding, solvent welding, or through the use of threaded fasteners, or other types of barbed structures known to those skilled in the arts.

As shown in FIGS. 3 and 14, the outboard ramping retention abutments engage approximately one-half of the circumference of the annular external recess 18 formed on each terminal 14. Because terminals 16 are retained for about one-half of the circumference of the annular external recess, the holding power of the connector upon the terminals is much greater than that of prior art connectors such as that shown in U.S. Pat. No. 3,937,545. As a result, a connector according to the present invention will be more resistant to failure occasioned by dislocation of the terminals due to pulling forces imposed by conductors 17, or pushing forces imposed by the insertion of a male terminal portion into the female connectors shown in the drawings herein. Another advantage of the present invention resides in the fact that the superior terminal retention ability provided by a connector according to this invention may allow the overall size of the connector, particularly the diameter of the generally tubular member, to be reduced without sacrificing the integrity of the connector.

A connector according to the present invention offers a further advantage inasmuch as the connector should be more easily manufactured because the superior terminal retention capability of the ramping retention abutments will render the connector more "forgiving" of manufacturing tolerance variations which could cause the molded parts of a connector to change dimensionally during a lengthy production run. In other words, because a more substantial structure is provided for retaining the terminals within the connector assembly, minor deviations in the dimensions of the molded portion of the connector, which would normally be sufficient to render other types of connectors inoperative, will not affect the integrity of a connector according to the present invention.

Those skilled in the art will appreciate in view of this disclosure that a connector according to the present invention could be constructed with more than the four terminals shown herein, it being understood that any number of pairs of terminals could be contained within a connector according to the present invention. Those skilled in the art will further appreciate in view of this disclosure that the conductors or wires entering an electrical connector according to the present invention could be sealed into the connector housing by means of a sealing material, such as rubber, with the sealing material placed within tubular member 8 in the area identified by numeral 38 in FIG. 2.

Figure 15:
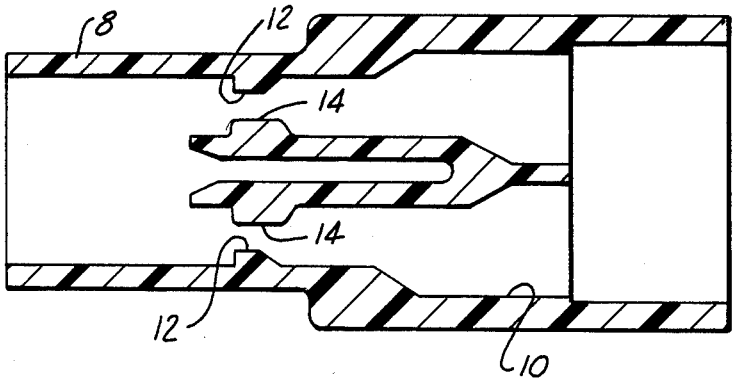
FIG. 15 is a cross-sectional view of a second embodiment of a connector according to the present invention.

FIG. 15, which is similar to FIG. 12, illustrates a second preferred embodiment of the present invention in which not only outboard ramping retention abutments but also inboard ramping retention abutments 14 are employed. Each inboard ramping retention abutment is formed integrally with a terminal guide finger such that at least one of said inboard abutments extends radially outward into each of the apertures of the generally tubular member, in correspondence with an outboard ramping retention abutment.

The connector shown in FIG. 15 could be employed in the event that even greater retention capability for the terminals 16 is desired. It should be understood, however, that addition of the inboard ramping retention abutments 14 will cause the overall diameter of the connector to be increased. This increase may not be desirable in certain applications and may, therefore, preclude inclusion in the connector of the inboard ramping retention abutments.

Various modifications and variations will no doubt occur to those skilled in the various arts to which this invention pertains. All such variations and modifications which basically rely on the teachings through which this disclosure has advanced the art are properly considered within the scope of this invention as defined by the appended claims.

I claim:

1. A separable electrical connector comprising:

an elongated, rigid, nonconductive, generally tubular member substantially open at either end;

a plurality of apertures extending axially through said tubular member;

a plurality of outboard ramping retention abutments formed integrally with said tubular member upon at least one inner surface of a radially outboard portion of said tubular member so that each of said apertures has at least one of said abutments extending radially inward into said aperture;

a plurality of axially connectable cylindrical electrical terminals adapted for coupling to the ends of insulated wires, where each terminal has an annular external recess in its cylindrical peripheral surface, with one of said terminals seated in each of said apertures such that said annular external recess of each terminal is engaged with at least one of said outboard ramping retention abutments;

a central land located within said tubular member and defining a portion of each of said apertures with said central land comprising a plurality of axially extending terminal guide fingers cantilevered from a bulkhead extending transversely across the interior of said tubular member, with each of said fingers having a portion extending in juxtaposition to one of said ramping retention abutments; and spacer means axially engaged with said central land for displacing said terminal guide fingers in the direction of said ramping retention abutments so that said ramping retention abutments will retain said terminals within said apertures, said spacer means comprising a unitary cover overlying an entire mating face on one of said ends of said tubular member and having a plurality of apertures extending therethrough for receiving a plurality of mating terminals, with at least one of said apertures corresponding to each of said apertures in said tubular member, said spacer means further comprising a plurality of blades cantilevered to said cover, with each of said blades interposed between two of said terminal guide fingers.

2. An electrical connector according to claim 1 wherein each of said outboard ramping retention abutments engages approximately one-half of the circumference of the annular external recess of each of said electrical terminals.

3. An electrical connector according to claim 1 further comprising a plurality of inboard ramping retention abutments formed integrally with said terminal guide fingers, with at least one of said inboard abutments extending radially outward into each of said apertures in said tubular member, in correspondence with said outboard ramping retention abutments.

* * * * *